US009010175B2

(12) United States Patent
Ward

(10) Patent No.: US 9,010,175 B2
(45) Date of Patent: Apr. 21, 2015

(54) DIE COOLANT SYSTEM WITH AN INTEGRAL AND AUTOMATIC LEAK TEST

(75) Inventor: Gary C. Ward, Saline, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 144 days.

(21) Appl. No.: 13/344,683

(22) Filed: Jan. 6, 2012

(65) Prior Publication Data

US 2013/0174648 A1 Jul. 11, 2013

(51) Int. Cl.
*G01M 3/04* (2006.01)
*B22D 17/22* (2006.01)

(52) U.S. Cl.
CPC ..... *B22D 17/2218* (2013.01)

(58) Field of Classification Search
CPC ..... B22D 17/2218; B29C 45/7312
USPC ..... 73/40, 40.7; 164/151
See application file for complete search history.

(56) References Cited

U.S. PATENT DOCUMENTS

| | | | | |
|---|---|---|---|---|
| 4,729,419 | A | 3/1988 | Nakamura et al. | |
| 6,827,323 | B2 * | 12/2004 | Minemoto | 249/79 |
| 8,272,865 | B2 * | 9/2012 | Higashi et al. | 425/547 |
| 2003/0015002 | A1 * | 1/2003 | Flynn | 65/356 |
| 2004/0216514 | A1 * | 11/2004 | Nunnally et al. | 73/40 |
| 2005/0133536 | A1 * | 6/2005 | Kelsey et al. | 222/181.1 |
| 2005/0276880 | A1 * | 12/2005 | Saeki et al. | 425/547 |
| 2006/0042771 | A1 * | 3/2006 | Ward | 164/122 |
| 2008/0066524 | A1 * | 3/2008 | Cummings | 73/40.7 |
| 2010/0187709 | A1 * | 7/2010 | Wang et al. | 264/40.6 |
| 2011/0115120 | A1 * | 5/2011 | Hattori et al. | 264/237 |

FOREIGN PATENT DOCUMENTS

| | | | |
|---|---|---|---|
| CN | 1921928 | A | 2/2007 |
| DE | 2242524 | B1 | 5/1974 |
| DE | 281232 | A5 | 8/1990 |
| DE | 4335838 | C1 | 2/1995 |
| DE | 10254219 | A1 | 6/2004 |
| DE | 102007013202 | A1 | 9/2008 |

* cited by examiner

*Primary Examiner* — Hezron E Williams
*Assistant Examiner* — David Z Huang
(74) *Attorney, Agent, or Firm* — Fraser Clemens Martin & Miller LLC; James D. Miller

(57) ABSTRACT

Systems and methods allow detection and location of die coolant leaks while a die is in a die cast machine and at operating temperature. The testing can be performed during normal down time of the die casting assembly and repeated as desired. Cooling circuits of the die can be tested in zones where zones are sorted to identify particular cooling circuits as having leaks as necessary. Valving, leak sensors, air decay units, and added machine control are provided in the die cooling system to enable onboard leak testing of the die while installed in the die casting machine.

13 Claims, 2 Drawing Sheets

DIE COOLANT SYSTEM WITH AN INTEGRAL AND AUTOMATIC LEAK TEST

FIELD OF THE INVENTION

The present technology relates to detection of coolant leaks in die casting, including detecting and pinpointing die coolant leaks while a die is in a die cast machine.

BACKGROUND OF THE INVENTION

This section provides background information related to the present disclosure which is not necessarily prior art.

Various casting processes for forming articles can use dies having a mold cavity with cavity inserts that can include one or more core elements. The mold cavity can be formed of outer molds and inner core elements each having features and reliefs that form details, recesses, and cavities in a casting when molten material such as liquid metal is poured or forced into the mold. For example, casting processes can be used to form engine blocks and transmission housings from molten aluminum alloys for use in internal combustion engines and transmissions for vehicles and other applications. Inner core elements can be constructed from bonded sand where the inner core elements can be extracted from the casting subsequent to the forming process.

Portions of a cast article can be subject to high-stress in use, and it can be desirable to impart varying metallurgical properties to such portions. For example, a time-rate removal of thermal energy from liquid metal during casting can affect grain structure. Increased cooling and solidification of the poured liquid metal can lead to an improvement, in some cases, of material properties such as tensile strength, fatigue strength, and machinability. To this end, casting processes can use heat transfer devices in proximity to specific portions of a casting in place of or in conjunction with features on the mold and core elements. For example, heat transfer devices can be used to control the cooling rate at bulkheads and crankshaft bearing surfaces on cast engine blocks.

Heat transfer devices for controlling the cooling rate of cast articles can include devices that circulate a coolant such as water through one or more portions of a die casting assembly. However, leakage of die cooling water can cause quality issues with the cast article. Die cooling water leaks can also be difficult to detect and locate. Leaks can occur in various parts of a die casting assembly, including valves, tubes, pipes, fittings, and/or die cracks. In some instances, a leak can start after the die has run several shots or the leak may not occur until the die is hot and/or stressed during lock-up. Since leaks can be hard to find and can present quality issues, multiple castings failing to meet desired specifications can be made before the leak is identified and fixed. Moreover, where the casting process employs vacuum, the vacuum can exacerbate the leak as it can pull leaking coolant into the die cavity.

Checking for leaks can include pressure checking the die in the tool room prior to set-up. Leaks can be visually checked by inspecting for coolant. For example, the die is heated in the die casting assembly, the die is closed, water and vacuum are turned on, and the die is then manually opened and inspected for leaks. Post-casting inspection can also reveal signs of leaks which can manifest as dark stains on a casting. However, such methods are labor intensive and remove the die casting assembly from fabrication, reducing production times and increasing costs.

SUMMARY OF THE INVENTION

The present technology includes systems, processes, and articles of manufacture that relate to detection and pinpointing die coolant leaks while a die is in the die cast machine and up to temperature. Leaks are detected during normal down time to minimize any workflow interruption. The entire die can be tested using various zones and then testing shifted to sorting of particular circuits if one or more leaks are found to identify the individual leaking circuit(s).

In some embodiments, a die cooling system comprises a die including a cooling circuit and a coolant source fluidly coupled to the cooling circuit. A pressurized gas source is configured to pressurize the cooling circuit. A sensor is configured to measure a gas pressure decay within the cooling circuit. In various embodiments, the die can comprise a plurality of cooling circuits, the pressurized gas source is configured to collectively pressurize more than one cooling circuit of the plurality of cooling circuits, and the sensor is configured to measure the gas pressure within the collectively pressurized cooling circuits. Cooling circuits can include an inlet and an outlet. The inlet can have a first end and a second end where the first end of the inlet is fluidly coupled to the die. The outlet can have a first end and second end where the first end of the outlet is fluidly coupled to the die. An inlet valve can be fluidly coupled to the second end of the inlet and an outlet valve can be fluidly coupled to the second end of the outlet. The pressurized gas source can be fluidly coupled to a gas valve and the gas valve can be fluidly coupled to the inlet valve.

In some embodiments, a method for leak testing a die cooling system is provided. The method includes purging coolant from a cooling circuit of a die and pressurizing the cooling circuit with a gas. The pressure of the gas within the pressurized cooling circuit is measured and compared to a specification. The cooling circuit is identified as having a leak if the measurement is not within the specification. In various embodiments, the purging comprises purging coolant form a plurality of cooling circuits of the die and the pressurizing comprises collectively pressurizing more than one cooling circuit of the plurality of cooling circuits with the gas. The gas pressure can then be measured within the collectively pressurized cooling circuits. The collectively pressurized cooling circuits can be identified as having a leak if the measurement is not within the specification. In certain embodiments, methods can further comprises sorting the collectively pressurized cooling circuits if the measurement is not within the specification, where the sorting includes individually pressurizing one of the cooling circuits from the collectively pressurized cooling circuits, measuring the gas pressure within the individually pressurized cooling circuit, and identifying the individually pressurized cooling circuit as having a leak if the measurement is not within a specification.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only of selected embodiments and not all possible implementations, and are not intended to limit the scope of the present disclosure.

DETAILED DESCRIPTION OF EXEMPLARY EMBODIMENTS OF THE INVENTION

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. Regarding the methods disclosed, the order of the steps presented is exemplary in nature, and thus, the order of the steps can be different in various embodiments.

The present technology provides die cooling systems with integral and automatic leak testing. One or more valves, leak sensors, air decay units, and added machine controls are included in a die cooling system to enable on-board leak testing of a die while installed in a die casting machine. The die cooling system includes air purge and controlled shut off valves to test for leaks using pressurized air. An air decay sensor is in communication with one or more air purge lines and a controlled switch box allows selection of various sensors and outputs. As such, dies within a casting assembly can be leak tested in situ, while the die casting assembly is in standby. Air purge of die casting cooling lines can therefore detect one or more leaks in the die during downtime, particularly while the die is still hooked up to the casting machine and at operating temperatures.

Figure 1:
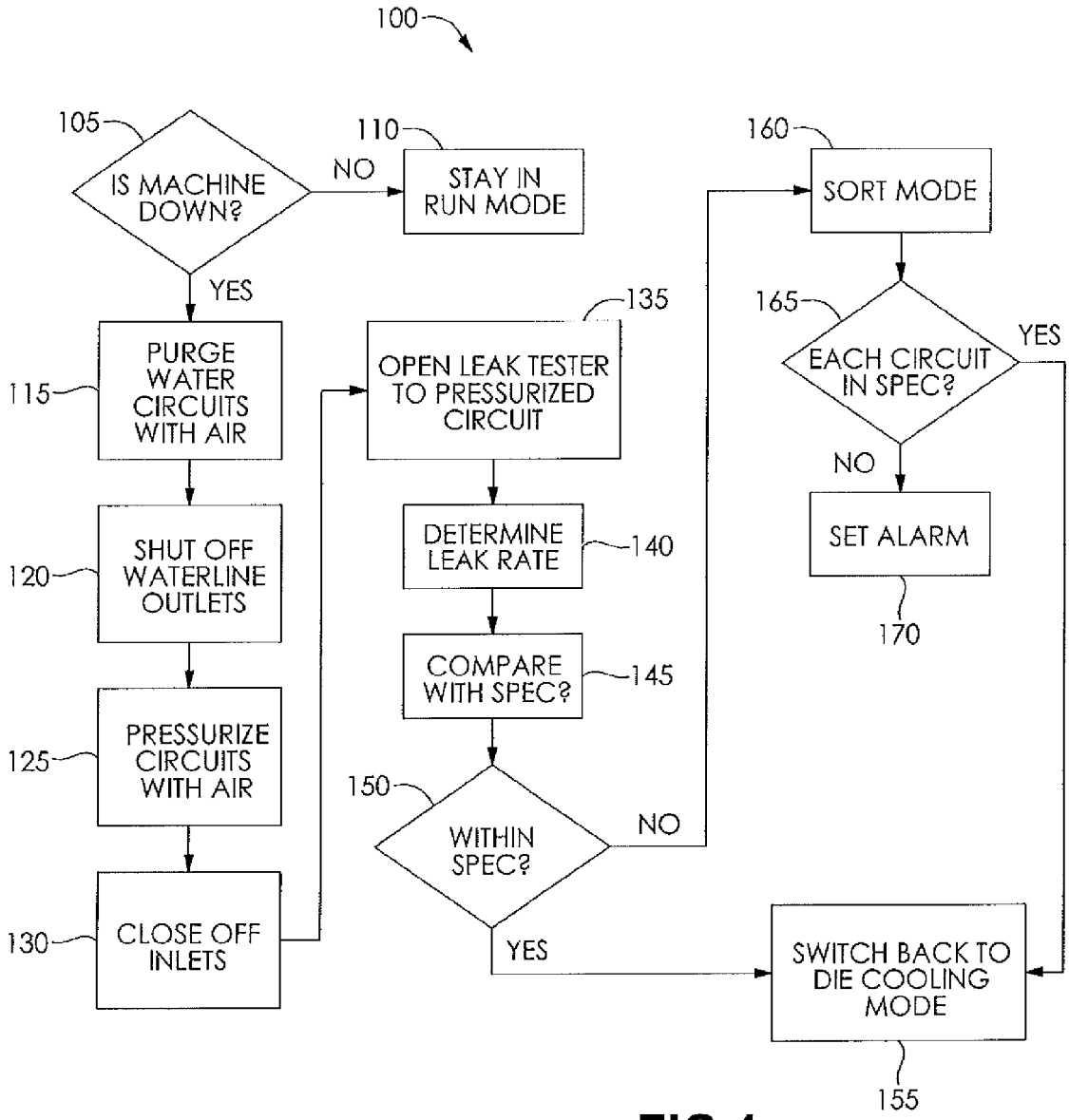
FIG. 1 is a flowchart depicting an embodiment of a method for leak testing a die cooling system according to the present technology.

Referring now to FIG. 1, a flowchart depicting a method for leak testing a die cooling system is shown at 100. At the outset, it is determined whether the die casting machine down, as shown at 105, meaning whether the die casting machine is in the process of or scheduled to perform a casting operation. If the answer is "no," meaning the die casting machine is currently in a casting operation or scheduled to perform a casting operation, the die casting machine stays in run mode, as depicted at 110. That is, the leak testing method 100 is not initiated. If the answer is "yes," and the die casting machine is down, the leak testing method 100 is initiated.

The method 100 proceeds at 115 to purge coolant (e.g., water) from one or more cooling circuits of the die cooling system using a gas (e.g., air). A die cooling system can have multiple cooling circuits that can be divided into one or more zones. In this fashion, particular zones can be interrogated for leaks to collectively test multiple circuits. Should a potential leak issue arise within a particular zone, the circuits making up that zone can be individually tested in order to sort which circuit(s) is responsible for the leak(s).

Following the purge of coolant, an outlet from the purged cooling circuit is shut off (e.g., using a valve) as shown at 120, for example, and the purged cooling circuit is pressurized with a gas (e.g., air) at 125. The gas could be the same gas used in the purge at 115 or could be a different gas. An inlet is closed at 130 (e.g., using a valve) to contain the pressurized gas within the circuit and a leak tester is placed in communication with the pressurized cooling circuit at 135. For example, an air decay unit can be used to measure the gas pressure within the pressurized cooling circuit, can be used to measure changes in the gas pressure over time, and can be used to measure differences in the gas pressure compared to a predetermined value or a set value, where the difference may include increases or decreases in pressure relative to the predetermined value or the set value. In this manner, a leak rate can be determined at 140 and compared with a specification value at 145, such as a pressure change value, predetermined value, and/or set value. If the gas pressure is within a target specification, the method 100 switches back to a die cooling mode, as shown at 155, so that the die casting machine is ready for a casting operation. If the gas pressure is not within the target specification, the method 100 switches to a sorting mode at 160.

The sorting mode 160 leak tests individual circuits for leaks. For example, a zone comprising multiple circuits of a cooling system can be collectively tested as shown in 115 through 150. If the zone as a whole fails to fall within a specification value 145, each circuit in the zone can be individually tested in the sorting mode 160 to identify the one or more particular circuits at fault. If a particular circuit is within a specification value 165, that circuit is clear to return to die cooling mode as shown at 155. However, if a particular circuit fails to meet a specification value, a signal such as an alarm can be provided to indicate a leak is present. The signal can facilitate diagnosis of the leak location based on the particular circuit. For example, this can limit the diagnosis to particular components of the die cooling system, including or more valves, portions of tubing or cooling conduits, or dies associated with the particular leaky cooling circuit, thereby focusing repair and/or replacement efforts. Once all cooling circuits are within specification, either by meeting the appropriate specification value or following repair or replacement, the circuits can be switched back to die cooling mode 155 to allow the die casting machine to perform a die casting operation.

Figure 2:
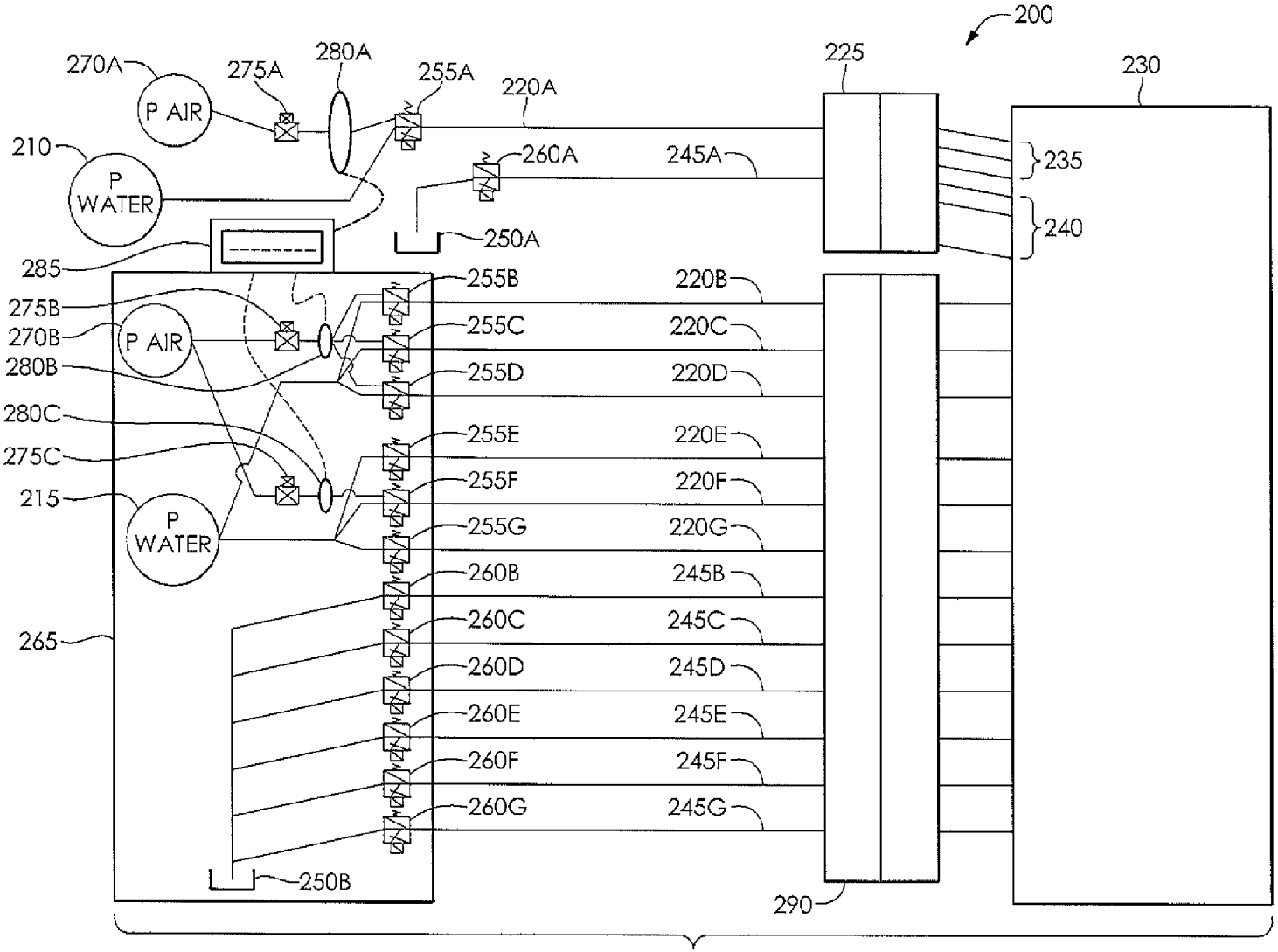
FIG. 2 is a schematic diagram depicting an embodiment of a die casting assembly including a die cooling system and a die according to the present technology.

The method illustrated in FIG. 1 can be effected using a die casting assembly 200 including a die cooling system 205, as shown in FIG. 2, and the various aspects further described herein. With reference to FIG. 2, one or more coolant sources (e.g., water) are coupled to the die cooling system 205, such as a potable water source 210 and/or a jet cool water source 215, to circulate the coolant through one or more cooling circuits. The potable water source 210 can provide the coolant from a municipal or plant reservoir to a cooling circuit including an inlet 220A running to a water manifold 225 coupled to a die 230. The water manifold 225 can provide the coolant to one or more cooling passages 235 running to the die 230 to pass through and cool the die 230. The die 230 can include one or more cooling passages (not shown) based on the configuration of the die 230, the extent of cooling desired, and cooling location(s) for a particular die casting operation. The coolant can return from the die 230 through one or more return passages 240, through the water manifold 225, and through an outlet 245A to a reservoir 250A, thereby completing the cooling circuit. The reservoir 250A can allow the coolant returning from the die 230 to cool and can include a heat exchanger or radiator (not shown) to facilitate cooling of the coolant where the cooled coolant can be reused as the potable water source 210 or can supplement the potable water source 210. An inlet valve 255A can be used to control the flow of the coolant into the inlet 220A and an outlet valve 260A can be used to control the flow of the coolant out of the outlet 245A. The inlet valve 255A and the outlet valve 260A can be directional solenoid valves, for example. The inlet valve 255A can be configured to selectively open and close the inlet 220A to the potable water source 210 and to a first pressurized gas (e.g., air) source 270A.

The die cooling system 205 can include the first pressurized gas source 270A coupled to the inlet 220A via the inlet valve 255A. The first pressurized gas source 270A can pass through a gas valve 275A, such as an open/shut valve, positioned upstream of the inlet valve 255A. A sensor 280A can be disposed between the gas valve 275A and the inlet valve 255A, where the sensor 280A is in communication with an air decay unit 285. In some embodiments (not shown), the sensor 280 can be positioned anywhere along one or more cooling circuits; e.g., the cooling circuit can run from valve 255A to inlet 220A, through the water manifold 225, through cooling passages 235 through the die 230, through return passages 240, again through the water manifold 225, to the outlet 245A, and to the outlet valve 260A.

The die cooling system 205 can also include a jet cool unit 265 coupled to the jet cool water source 215. The jet cool water source 215 provides water to various cooling circuits including inlets 220B, 220C, 220D, 220E, 220F, 220G running to a jet cool manifold 290 coupled to the die 230 to respective cooling passages (not shown) running through the die 230. As noted, the die 230 can include various cooling passages based on the configuration of the die 230, the extent of cooling desired, and cooling location(s) for a particular die casting operation. The water can return from the die 230, through the jet cool manifold 290, and through respective outlets 245B, 245C, 245D, 245E, 245F, 245G to a reservoir 250B; e.g., the coolant running through inlet 220B returns from the die 230 through outlet 245B, the coolant running through inlet 220C returns from the die 230 through outlet 245C, and so on. An example of a cooling circuit includes the path running from valve 255B to inlet 220B, through the jet cool manifold 290, to a cooling passage through the die 230, again through the jet cool manifold 290, to the outlet 245B, and to outlet valve 260A.

The reservoir 250B can allow the coolant returning from the die 230 to cool and can include a heat exchanger or radiator to facilitate cooling of the water (not shown) where the cooled water can be reused as the jet cool water source 215 or can supplement the jet cool water source 215. In some embodiments, the reservoir 250B can be the same as reservoir 250A or can be coupled to reservoir 250A. Inlet valves 255B, 255C, 255D, 255E, 255F, 255G can be used to control the flow of the water into the respective inlets 220B, 220C, 220D, 220E, 220F, 220G and outlet valves 260B, 260C, 260D, 260E, 260F, 260G can be used to control the flow of the water out of the respective outlets 245B, 245C, 245D, 245E, 245F, 245G. The inlet valves 255B, 255C, 255D, 255E, 255F, 255G and the outlet valves 260B, 260C, 260D, 260E, 260F, 260G can be directional solenoid valves, for example. It should be noted that various embodiments (not shown) of the die cooling system 205 can have a larger number or a smaller number of inlets, outlets, and associated valves than those shown.

The die cooling system 205 can also include a second pressurized gas source 270B (e.g., air) coupled to the inlets 220B, 220C, 220D, 220E, 220F, 220G via the inlet valves 255B, 255C, 255D, 255E, 255F, 255G. In some embodiments, the second pressurized gas source 270B can be part of the jet cool unit 265 or the second pressurized gas source 270B can be the same as the first pressurized gas source 270A. The second pressurized gas source 270B can pass through gas valves 275B, 275C (e.g., open/shut valves) and then branch to multiple inlet valves 255B, 255C, 255D, 255E, 255F, 255G a shown in FIG. 2. In this way, each of the valves 275B, 275C can define a separate zone of inlet valves 255B, 255C, 255D, 255E, 255F, 255G and their respective inlets 220B, 220C, 220D, 220E, 220F, 220G.

With reference to FIG. 2, the second pressurized gas source 270B flows through gas valve 275B and then branches to inlet valves 255B, 255C, 255D and respective inlets 220B, 220C, 220D to define a first zone. Likewise, the second pressurized gas source 270B flows through gas valve 275C and then branches to inlet valves 255E, 255F, 255G and respective inlets 220E, 220F, 220G to define a second zone. A sensor 280B can be disposed between the gas valve 275B and the branches leading to the inlet valves 255B, 255C, 255D and a sensor 280C can be disposed between the gas valve 275C and the branches leading to the inlet valves 255E, 255F, 255G. The sensors 280B, 280C are in communication with the air decay unit 285.

As shown, the jet cool unit 265 of the die cooling system 205 includes two zones (i.e., the first zone including the inlets 220B, 220C, 220D and the second zone including the inlets 220E, 220F, 220G) each comprising a set of three inlets. However, it should be noted that various configurations are possible, where one or more zones can be used, with each zone individually having one or more inlets. For example, the jet cool unit 265 can have one, two, three, four, five, or more zones, with each zone independently including one, two, three, four, five, or more inlets. Likewise, the first pressurized gas source 270A can be divided into multiple zones each having one or more gas valves even though the first pressurized gas source 270A is shown passing through only the one gas valve 275 and the sensor 280A to a single inlet valve 255A in FIG. 2.

The die cooling system 205 can operate in a die cooling mode where the coolant (e.g., water) from the sources 210, 215 is sent through the various cooling circuits including the respective inlets 220A, 220B, 220C, 220D, 220E, 220F, 220G to the manifolds 225, 290, through the die 230, and returning through the manifolds 225, 290 and the respective outlets 245A, 245B, 245C, 245D, 245E, 245F, 245G to the reservoirs 250A, 250B. The valves 255A, 255B, 255C, 255D, 255E, 255F, 255G are open to the coolant sources 210, 215 and the valves 260A, 260B, 260C, 260D, 260E, 260F, 260G are open to allow the coolant to flow to the reservoirs 250A, 250B. The gas valves 275A, 275B, 275C are closed, isolating the pressurized gas sources 270A, 270B.

The die cooling mode can then shift to a purge mode (e.g., 115 in FIG. 1) where the coolant is purged from the cooling circuits of the die cooling system 200 using pressurized gas. The valves 255A, 255B, 255C, 255D, 255E, 255F, 255G are positioned to close the inlets 220A, 220B, 220C, 220D, 220E, 220F, 220G to the coolant sources 210, 215 while opening the inlets 220A, 220B, 220C, 220D, 220E, 220F, 220G to the pressurized gas sources 270A, 270B. The gas valves 275A, 275B, 275C are opened allowing pressurized gas from the sources 270A, 270B to flow through, thereby purging coolant through the inlets 220A, 220B, 220C, 220D, 220E, 220F, 220G to the manifolds 225, 290, through the die 230, and returning through the manifolds 225, 290 and the respective outlets 245A, 245B, 245C, 245D, 245E, 245F, 245G to the reservoirs 250A, 250B.

Once substantially all of the coolant is purged, the valves 260A, 260B, 260C, 260D, 260E, 260F, 260G on the outlets 245A, 245B, 245C, 245D, 245E, 245F, 245G are closed to allow the gas from the pressurized gas sources 270A, 270B to pressurize the cooling circuits of the die cooling system 205 (e.g., 125 in FIG. 1). The gas valves 275A, 275B, 275C are then closed to isolate the pressurized gas sources 270A, 270B (e.g., 130 in FIG. 1). The sensors 280A, 280B, 280C are then used to determine if there is a leak in the die cooling system 205 pressurized with gas (e.g., 135, 140, 145, 150 in FIG. 1).

For example, sensor 280A is positioned in a closed circuit bounded on one end by the closed gas valve 275A, traveling through the open valve 255A, the inlet 220A, the water manifold 225, the cooling passages 235, the die 230, the return passages 240, back through the water manifold 225, the outlet 245A, to where it is bounded on the other end by the closed valve 260A. Likewise, the sensor 280B is positioned in a closed circuit comprising the first zone bounded on one end by the closed gas valve 275B, traveling through each of the open valves 255B, 255C, 255D, the inlets 220B, 220C, 220D, the jet cool manifold 290, the die 230, back through the jet cool manifold 290, the outlets 245B 245C, 245D, to where it is bounded on the other end by the closed valves 260B, 260C, 260D. The sensor 280C is positioned in a closed circuit comprising the second zone bounded on one end by the closed valve gas 275C, traveling through each of the open valves 255E, 255F, 255G, the inlets 220E, 220F, 220G, the jet cool manifold 290, the die 230, back through the jet cool manifold 290, the outlets 245E, 245F, 245G, to where it is bounded on the other end by the closed valves 260E, 260F, 260G. As described herein, various embodiments (not shown) can include various numbers of zones where each zone individually can include various numbers of inlets/outlets. There can accordingly be various embodiments with various numbers of closed circuits each pressurized with gas.

The sensors 280A, 280B, 280C are coupled to a leak tester such as the air decay unit 285. The air decay unit 285 uses the sensors 280A, 280B, 280C to measure pressures for comparison with a respective specification (e.g., 150 in FIG. 1). For example, the specification can be a set value for a particular closed circuit or can be a particular pressure differential value taken over a time period for the particular closed circuit. Pressure can be measured continuously over a time course or at one or more set time points or at one or more defined intervals. In this manner, the air decay unit 285 can determine whether there is a leak in a circuit and can determine a leak rate by comparing the pressure measurement(s) to a particular value and/or by determining whether there are changes between pressure measurements, such as continuous or successive pressure measurements.

If the pressure decay in a particular closed circuit is less than the specification, the closed circuit, which may include a zone of multiple inlets and outlets as described, can be switched back to die cooling mode (e.g., 155 in FIG. 1). For example, if the first zone described herein is within its specification, the die cooling mode can open the valves 260B, 260C, 260D to vent the pressurized gas to the reservoir 250B. Alternatively, one or more vent valves (not shown) can be positioned within the circuit(s) of the first zone to vent the pressurized gas to somewhere other than the reservoir 250B such as the atmosphere. The valves 255B, 255C, 255D are opened to the coolant source 215 to allow coolant to flow through the inlets 220B, 220C, 220D, the jet cool manifold 290, the die 230, back through the jet cool manifold 290, the outlets 245B 245C, 245D, and to the reservoir 250B to complete the return to die cooling mode. The same can be done for other zones or closed circuits that match or are within their respective specification.

If the pressure decay in a particular closed circuit is more than its specification, the closed circuit can be switched to a sort mode (e.g., 160 in FIG. 1) where the closed circuit includes a zone of multiple inlets and outlets as described. The sort mode allows the pressure within each individual circuit in the zone to be tested in order to identify the particular circuit in the zone that does not match its specification.

For example, if the pressure decay measurement for the whole of the first zone was not within its specification, the three cooling circuits making up the first zone are interrogated individually. The valves 260B, 260C, 260D are closed and the valves 255C, 255D are closed. The valve 255A is closed to the pressurized coolant source 215 and open to the pressurized gas source 270B. The gas valve 275B is opened to allow pressurized gas to fill the inlet 220B, the jet cool manifold 290, the die 230, back through the jet cool manifold 290, and the outlet 245B. The gas valve 275B is then closed. The sensor 280B is thereby positioned in a closed circuit of pressurized gas bounded on one end by the closed gas valve 275B, traveling through the open valve 255B, the inlet 220B, the jet cool manifold 290, the die 230, back through the jet cool manifold 290, the outlet 245B to where it is bounded on the other end by the closed valve 260B. There is no pressure communication with the cooling circuits including the valves 255C, 255D, the inlets 220C, 220D, the jet cool manifold 290, the die 230, the jet cool manifold 290, the outlets 245C, 245D, and the valves 260C, 260D. The pressure decay is then measured using the sensor 280B to determine if it matches or is within a specification. The other portions of the first zone are likewise individually tested: the sensor 280B is positioned in a closed circuit of pressurized gas bounded on one end by the gas valve 275B, traveling through the valve 255C, the inlet 220C, the jet cool manifold 290, the die 230, back through the jet cool manifold 290, the outlet 245C to where it is bounded on the other end by the valve 260C; and the sensor 280B is positioned in a closed circuit of pressurized gas bounded on one end by the gas valve 275B, traveling through the valve 255D, the inlet 220D, the jet cool manifold 290, the die 230, back through the jet cool manifold 290, the outlet 245D to where it is bounded on the other end by the valves 260D. The second zone and other zones can be tested in like fashion. In this way, a zone comprising multiple circuits of inlets/outlets that is not within its specification can have each of the circuits of inlets/outlets individually tested to sort which one or more may have a leak.

When a particular cooling circuit is not within its specification, the air decay unit 285 can set an alarm (e.g., 170 in FIG. 1). The alarm can be an audible and/or visual signal to an operator. The alarm can also include a representation or numerical value of how much the pressure decay measurement deviates from the specification for the particular circuit and/or how much the pressure decay changed over time, including changes between successive measurements. An operator can then identify and repair the particular leaking portion(s) of the die casting assembly.

In some instances, a particular circuit is not part of a multi-circuit zone, such as the first and second zones described herein. For example, the circuit comprising the valve 255A, the inlet 220A, the water manifold 225, the multiple cooling passages 235, the die 240, the multiple return passages 240, the outlet 245A, and the valve 260A does not include several inlets/outlets like the first and second zones. Accordingly, there is no need to use a sort mode with this circuit and the air decay unit 285 can set an alarm directly when the circuit is not within its specification; e.g., 160 and 165 in FIG. 1 are bypassed to proceed directly to 170.

In some embodiments, the air decay unit 285 can be coupled to or include a storage device (not shown) to record leak testing pressure measurements for later retrieval, for comparison over the life of the die 230 and production runs, and/or for later output to an output device (not shown). The storage device can also include specification values for particular circuits for particular dies for use in methods for leak testing a die cooling system (e.g., 100 in FIG. 1) and die casting assemblies (e.g., 200 in FIG. 2) including die cooling systems (e.g., 205 in FIG. 2). An interface (not shown) can be provided to allow an operator to retrieve, modify, and/or update data from the storage device and/or data generated or used by the leak tester (e.g., air decay unit).

The present technology provides several benefits to die casting. Since leak checking can be done automatically during down time, no production time is lost. If the die casting machine is turned back to an automatic mode during a leak check, the system can be set to abort the leak test and go immediately back to die cooling mode. Leak checks can be done during each down time so several leak checks can be done every day. Leak checking can be done when the die is at operating temperature and in place so that the system can be evaluated for leaks using operating conditions. Depending on valving and break down of circuits into various zones, leaks can be quickly identified and then narrowed down to individual circuits. Leaks can be identified early in the die casting process, even if they develop during a run, where the run can be interrupted to prevent making castings that fail to meet desired specifications. Shot number can also be recorded when the leak check occurs for lot control.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. Equivalent changes, modifications and variations of some embodiments, materials, compositions and methods can be made within the scope of the present technology, with substantially similar results.

What is claimed is:

1. A die cooling system comprising:

a die including a plurality of cooling circuits, wherein each of the cooling circuits comprises:

an inlet including a first end and a second end, the first end of the inlet fluidly coupled to the die;

an outlet including a first end and second end, the first end of the outlet fluidly coupled to the die;

an inlet valve fluidly coupled to the second end of the inlet; and an outlet valve fluidly coupled to the second end of the outlet;

a coolant source fluidly coupled to the inlet valve of each of the cooling circuits;

a pressurized gas source;

a gas valve disposed between the pressurized gas source and the inlet valve of each of the cooling circuits for selectively providing fluid communication therebetween;

a single conduit conveying a gas from the pressurized gas source to the gas valve and a plurality of conduits branching out from the single conduit downstream of the gas valve, wherein each of the conduits branching out from the gas valve is fluidly coupled to a corresponding one of the inlet valves; and a sensor configured to measure a gas pressure within the cooling circuit, wherein the sensor is disposed between the gas valve and the inlet valve of each of the cooling circuits.

2. The die cooling system of claim 1, wherein the sensor is coupled to an air decay unit configured to measure a change in the gas pressure within the plurality of cooling circuits.

3. The die cooling system of claim 1, wherein the pressurized gas source is configured to collectively pressurize more than one cooling circuit of the plurality of cooling circuits, and the sensor is configured to measure the gas pressure within the collectively pressurized cooling circuits.

4. The die cooling system of claim 1, further comprising a manifold fluidly coupling the first end of the inlets to the die and fluidly coupling the first end of the outlets to the die.

5. The die cooling system of claim 1, further comprising an alarm configured to actuate when the sensor measures the gas pressure in the plurality of cooling circuits and the gas pressure is outside of a predetermined range.

6. The die cooling system of claim 1, further comprising an alarm configured to actuate when the sensor measures a decay in the gas pressure in one of the cooling circuits and the decay in the gas pressure is outside of a predetermined range, wherein the alarm identifies the one of the cooling circuits having the decay in the gas pressure that is outside of the predetermined range.

7. A method for leak testing a die cooling system comprising:

purging a coolant from a plurality of cooling circuits of a die;

collectively pressurizing the plurality of cooling circuits with a gas;

measuring a pressure decay of the gas within the collectively pressurized cooling circuits and comparing the measured pressure decay to a specification; and identifying the collectively pressurized cooling circuits as having a leak if the measured pressure decay is more than the specification;

wherein each of the cooling circuits comprises:

an inlet including a first end and a second end, the first end of the inlet fluidly coupled to the die;

an outlet including a first end and second end, the first end of the outlet fluidly coupled to the die;

an inlet valve fluidly coupled to the second end of the inlet, wherein the inlet valve is configured to selectively fluidly couple the inlet to each of a gas valve and a coolant source; and an outlet valve fluidly coupled to the second end of the outlet;

wherein the gas valve is disposed between a pressurized gas source and the inlet valve of each of the cooling circuits for selectively providing fluid communication therebetween, and a sensor for measuring the pressure decay of the gas is disposed between the gas valve and the inlet valve of each of the cooling circuits; and wherein a single conduit conveys the gas from the pressurized gas source to the gas valve and a plurality of conduits branch out from the single conduit downstream of the gas valve, wherein each of the conduits branching out from the gas valve is fluidly coupled to a corresponding one of the inlet valves.

8. The method of claim 7, further comprising sorting the collectively pressurized plurality of cooling circuits if the measured pressure decay is more than the specification, the sorting comprising:

individually pressurizing one of the cooling circuits from the collectively pressurized plurality of cooling circuits, measuring a pressure decay of the gas within the pressurized one of the cooling circuits, and identifying the pressurized one of the cooling circuits as having a leak if the measurement is more than the specification.

9. The method of claim 8, further comprising repeating the sorting until an individually pressurized cooling circuit is identified as having a leak.

10. The method of claim 8, further comprising repeating the sorting for all of the cooling circuits from the collectively pressurized plurality of cooling circuits.

11. The method of claim 7, further comprising:

determining whether a die casting assembly comprising the die is in a standby mode prior to purging the coolant from the cooling circuit of the die, and proceeding to purge the coolant from the cooling circuit of the die if the die casting assembly is in the standby mode.

12. The method of claim 7, wherein the gas valve is a 2-way open/shut valve.

13. The method of claim 12, wherein the inlet valve is a 3-way valve having a first port configured to selectively provide fluid communication between the inlet and the coolant source, a second port configured to selectively provide fluid communication between the inlet and the pressurized gas source, and a third port fluidly coupled to the second end of the inlet.

* * * * *